US008956171B2

(12) United States Patent
Wang

(10) Patent No.: US 8,956,171 B2
(45) Date of Patent: Feb. 17, 2015

(54) ELECTRICAL CONNECTOR

(71) Applicant: Cheng UEI Precision Industry Co., Ltd., New Taipei (TW)

(72) Inventor: Han-Wei Wang, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 31 days.

(21) Appl. No.: 13/936,124

(22) Filed: Jul. 5, 2013

(65) Prior Publication Data

US 2015/0011130 A1 Jan. 8, 2015

(51) Int. Cl.
*H01R 13/15* (2006.01)
*H01R 13/432* (2006.01)

(52) U.S. Cl.
CPC ..... *H01R 13/432* (2013.01)
USPC ..... 439/260

(58) Field of Classification Search
USPC ..... 439/260, 263, 259
See application file for complete search history.

(56) References Cited

U.S. PATENT DOCUMENTS

| | | | | |
|---|---|---|---|---|
| 6,435,892 | B1 * | 8/2002 | Billman | 439/260 |
| 8,662,916 | B2 * | 3/2014 | Ashibu | 439/495 |
| 2010/0184317 | A1 * | 7/2010 | Sunaga | 439/260 |

* cited by examiner

*Primary Examiner* — Phuong Dinh
(74) *Attorney, Agent, or Firm* — Cheng-Ju Chiang

(57) ABSTRACT

An electrical connector includes an insulating housing defining an inserting chamber and terminal grooves communicating with the inserting chamber, electrical terminals of which each has an elastic arm received in the terminal groove and a contact portion protruding towards the inserting chamber at a front end of the elastic arm, and a pressing member slidably sleeved round a front of the insulating housing. A plurality of pressing blocks is protruded at inner sides of the pressing member and projects in the terminal grooves to resist against the elastic arms. The contact portions are located in the terminal grooves when the pressing member is at an initial position. After a mating connector is mated with the electrical connector, push the pressing member rearward to make the pressing blocks press the elastic arms so as to make the contact portions project into the inserting chamber and contact with the mating connector.

10 Claims, 7 Drawing Sheets

ELECTRICAL CONNECTOR

BACKGROUND OF THE INVENTION

1. Field of the Invention

The present invention generally relates to a connector, and more particularly to an electrical connector.

2. The Related Art

Along with the development of various kinds of multimedia devices on the market, in addition to integrate more functions in one, information transmission rates are often required to pay attention. At present, using transmission lines as transmission medium is still the most basic and common way of transmitting information. A product capable of electrically connecting with the transmission lines is still mainstream product on the market. With the rapid development of electronic technology, the product is required to give consideration to both high speed information transmission rate and miniaturization structure. So a prenatal online test for the product has become increasingly important, and accordingly for achieving the prenatal online test, a mating electrical connector is required to be located on the test machine.

However, in test, the product and the electrical connector are mated in a single direction for insertion and extraction. And in the process of insertion and extraction, electrical terminals of the product and the electrical connector interfere with each other so that often easily scrapes the product under test.

SUMMARY OF THE INVENTION

An object of the present invention is to provide an electrical connector adapted for mating with a mating connector. The electrical connector includes an insulating housing, a plurality of electrical terminals and a pressing member. The insulating housing has a top wall, a bottom wall, a rear wall and two side walls which together surround an inserting chamber thereamong. The top wall and the bottom wall define a plurality of terminal grooves vertically penetrating therethrough to communicate with the inserting chamber and each extending along a front-to-rear direction. The electrical terminals are disposed in the terminal grooves of the insulating housing. Each of the electrical terminals has an elastic arm elastically received in the terminal groove, and a contact portion protruding towards the inserting chamber at a front end of the elastic arm. The contact portion is located in the front of the terminal groove. The pressing member has a top board, a bottom board and two side boards. The pressing member is slidably sleeved round a front part of the insulating housing. Two inner sides of the top board and the bottom board protrude face-to-face inward to form two rows of pressing blocks which are arranged at regular intervals in accordance with the terminal grooves of the insulating housing to project in the terminal grooves and resist against the elastic arms of the electrical terminals respectively.

When the pressing member is at an initial position relative to the insulating housing, the contact portions of the electrical terminals are located in the terminal grooves and there is no interference between the electrical terminals and the mating connector in the process of inserting the mating connector into the electrical connector. After the mating connector is completely mated with the electrical connector, push the pressing member to slide rearward along the insulating housing so as to make the pressing blocks press the elastic arms to make the contact portions project into the inserting chamber and electrically contact with the mating connector.

As described above, there is no interference between the electrical terminals and the mating connector in the process of inserting the mating connector into the electrical connector, and an electrical connection is realized between the electrical terminals and the mating connector by virtue of pushing the pressing member to slide rearward along the insulating housing after the mating connector is completely mated with the electrical connector, so that effectively avoid scraping the mating connector in the process of insertion and extraction.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
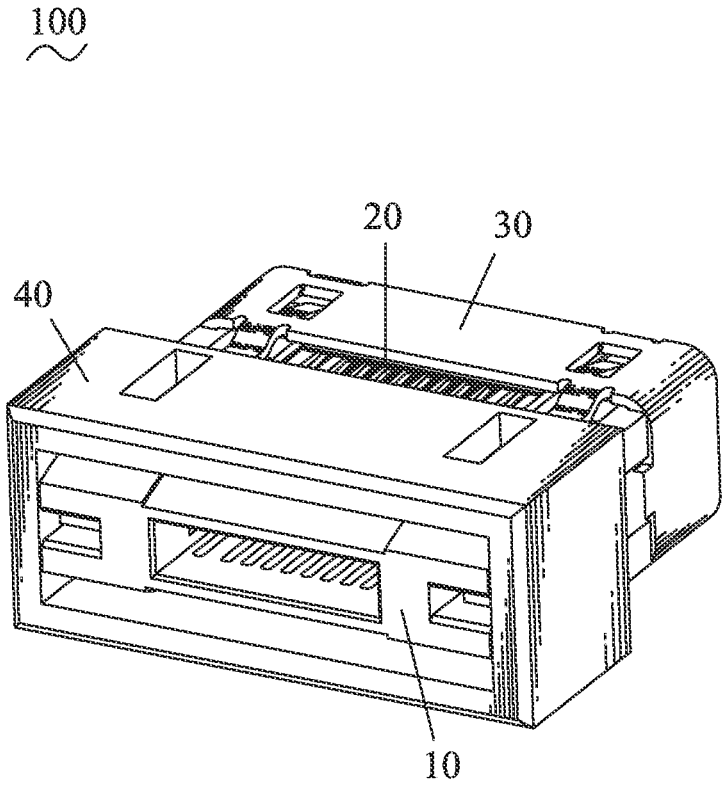
FIG. 1 is an assembled perspective view of an electrical connector according to an embodiment of the present invention.

With reference to FIG. 1, an electrical connector 100 in accordance with an embodiment of the present invention is adapted for mating with a mating connector (not shown). The electrical connector 100 includes an insulating housing 10, a plurality of electrical terminals 20, a shell 30 and a pressing member 40.

Figure 2:
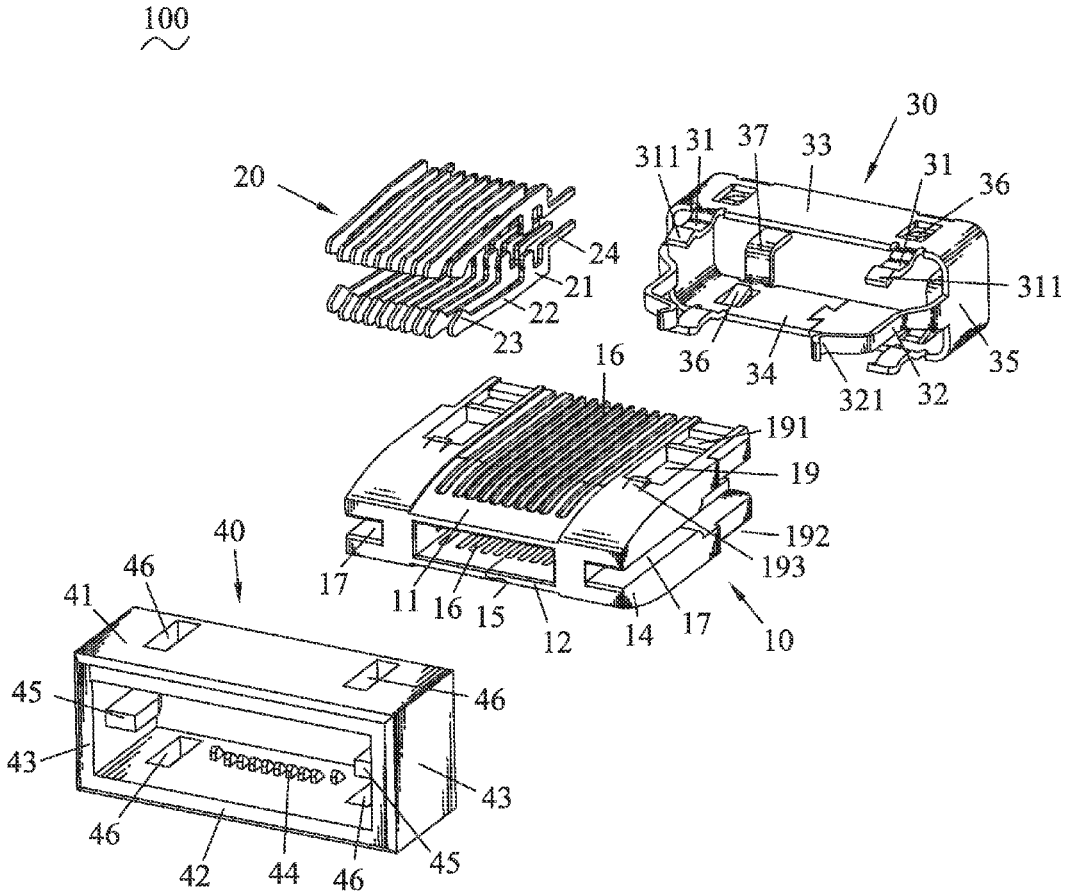
FIG. 2 is an exploded perspective view of the electrical connector of FIG. 1.
Figure 3:
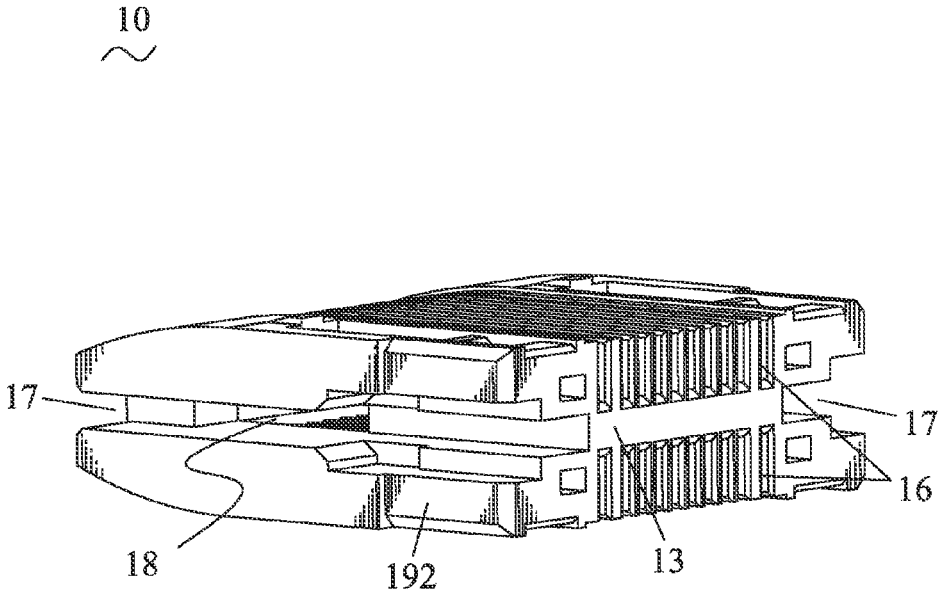
FIG. 3 is a perspective view of an insulating housing of the electrical connector of FIG. 1.

Referring to FIG. 2 and FIG. 3, the insulating housing 10 has a top wall 11, a bottom wall 12, a rear wall 13 and two side walls 14 which together surround an inserting chamber 15 thereamong. The top wall 11 and the bottom wall 12 define a plurality of terminal grooves 16 which are opened symmetrically about the inserting chamber 15 and vertically penetrate through the top wall 11 and the bottom wall 12 respectively to communicate with the inserting chamber 15. Each of the terminal grooves 16 extends along a front-to-rear direction to further penetrate through the rear wall 13. Two opposite outsides of the side walls 14 are concaved inward to form a pair of sliding channels 17 extending along the front-to-rear direction to penetrate through the corresponding side walls 14. A pair of through grooves 18 is face-to-face opened in substantial middles of insides of the side walls 14 and transversely connect the corresponding sliding channels 17 with the inserting chamber 15. Two top faces and two bottom faces of the side walls 14 define a pair of fillisters 19 respectively opened at substantial middles thereof and located at two opposite sides of the corresponding terminal grooves 16. The top faces and the bottom faces of the side walls 14 further define a plurality of buckling grooves 191 arranged behind the fillisters 19 respectively, and a plurality of wedge-shaped blocking blocks 193 protruded in front of the fillisters 19 respectively. Two rear ends of the two opposite outsides of the side walls 14 are concaved inward to form a pair of fastening grooves 192 vertically extending to penetrate through the corresponding side walls 14.

Figure 6:
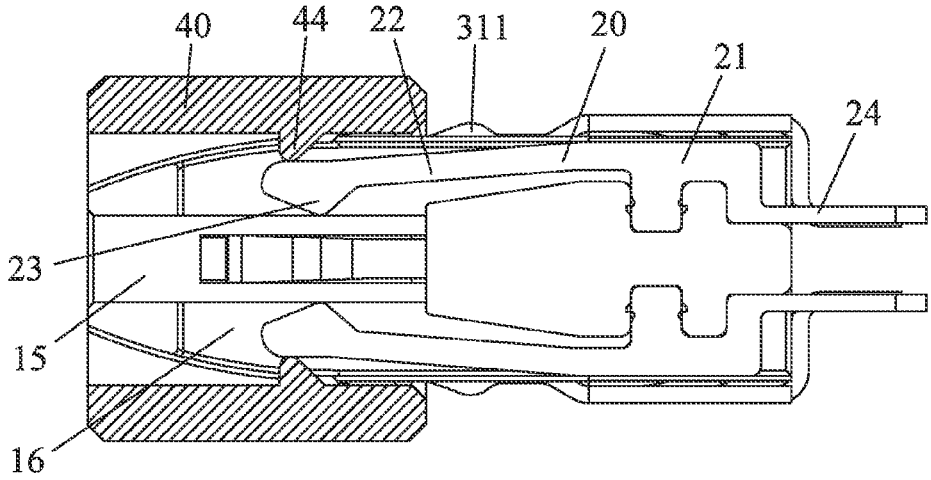

Referring to FIG. 1, FIG. 2 and FIG. 6, the electrical terminals 20 are symmetrically arranged in two rows and disposed in the terminal grooves 16 of the insulating housing 10. Each of the electrical terminals 20 has a board-shaped fastening portion 21 vertically fastened in the rear of the corresponding terminal groove 16, an elastic arm 22 extending forward from a front edge of the fastening portion 21 and inclined towards the inserting chamber 15 in the process of extending forward, a contact portion 23 protruding towards the inserting chamber 15 from a distal end of the elastic arm 22, and a soldering tail 24 extending rearward from a rear edge of the fastening portion 21. The elastic arm 22 is received in the terminal groove 16 with the contact portion 23 being also located in the front of the terminal groove 16 when the electrical connector 100 is not in use. The soldering tail 24 stretches rearward out of the terminal groove 16 and projects behind the rear wall 13.

Referring to FIG. 1, FIG. 2, FIG. 3 and FIG. 4, the shell 30 is substantially of a rectangular ring shape and encloses a rear part of the insulating housing 10. The shell 30 has a top plate 33, a bottom plate 34 and two side plates 35 positioned in the fastening grooves 192 of the side walls 14. Front edges of the top plate 33 and the bottom plate 34 curvedly extend forward to form a plurality of locking arms 31 located in the fillisters 19 respectively. In detail, each of the locking arms 31 has a substantial middle arched into the fillister 19 to be buckled in the corresponding fillister 19. A distal end of each locking arm 31 is further arched outward to form a locking portion 311 projecting upward/downward out of the fillister 19 and beyond the top/bottom face of the corresponding side wall 14, wherein the locking portions 311 of the shell 30 are in alignment with the corresponding blocking blocks 193 and spaced behind the blocking blocks 193 respectively.

Front edges of the side plates 35 extend forward and are curved towards each other more than once in the process of extending forward to form a pair of elastic strips 32 of lying step shape. Two distal ends of the elastic strips 32 are further arched towards each other to form a pair of locking sections 321. The elastic strips 32 are respectively disposed in the rears of the sliding channels 17 of the insulating housing 10, and the locking sections 321 stretch in the through grooves 18.

The top plate 33 and the bottom plate 34 have two sides thereof punched inward to form two pairs of inclined buckling slices 36 buckled in the buckling grooves 191 of the insulating housing 10 respectively. Rear edges of the top plate 33 and the bottom plate 34 are bent towards each other and then extend rearward to form a plurality of soldering feet 37 located behind the insulating housing 10 and abutting against the back of the insulating housing 10. In this embodiment, the side plates 35 are positioned in the fastening grooves 192 of the side walls 14, the locking arms 31 are buckled in the fillisters 19 and the buckling slices 36 are buckled in the buckling grooves 191 respectively, so that can make the shell 30 and the insulating housing 10 be firmly secured together.

Referring to FIG. 1, FIG. 2, FIG. 4 and FIG. 6, the pressing member 40 is a rectangular frame which has a top board 41, a bottom board 42 and two side boards 43. Two sides of each of the top board 41 and the bottom board 42 are opened with a pair of sliding slots 46 each extending along a front-to-rear direction. Two inner sides of the top board 41 and the bottom board 42 protrude face-to-face inward to form two rows of pressing blocks 44. Each row of the pressing blocks 44 are arranged at regular intervals between one pair of the sliding slots 46 and in accordance with the terminal grooves 16 of the insulating housing 10 opened in the top/bottom wall 11/12. Two inner sides of the side boards 43 protrude face-to-face inward to form a pair of slide blocks 45.

Figure 4:
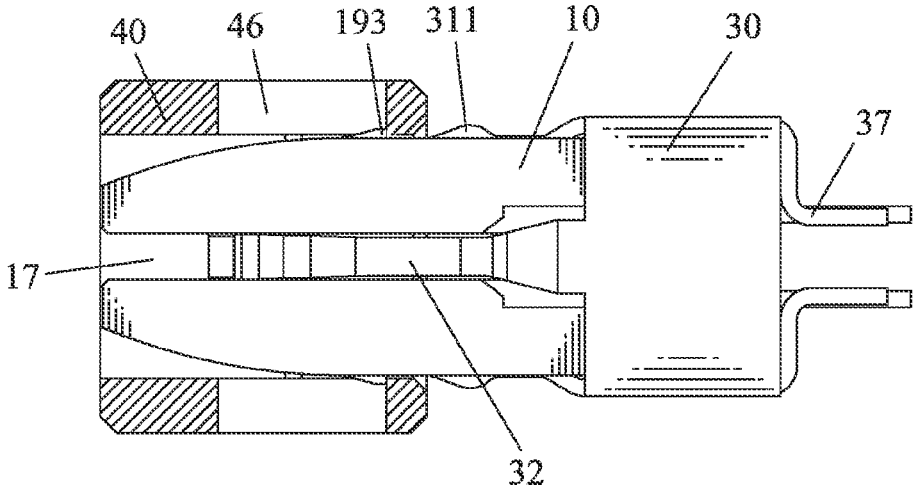
FIGS. 4-7 are cross-sectional views showing that a pressing member of the electrical connector of FIG. 1 is at two different positions relative to the insulating housing of the electrical connector of FIG. 1.

The pressing member 40 is slidably sleeved round a front part of the insulating housing 10. The slide blocks 45 are inserted in the front of the sliding channels 17. The pressing blocks 44 project in the terminal grooves 16 respectively and resist against the elastic arms 22 of the corresponding electrical terminals 20. The blocking blocks 193 are located in the corresponding sliding slots 46 against rear sidewalls of the sliding slots 46 and apart from front sidewalls of the sliding slots 46. The locking portions 311 of the locking arms 31 of the shell 30 are located behind the pressing member 40 and in alignment with the sliding slots 46 respectively. Referring to FIG. 4 and FIG. 6, in this state, insert the mating connector into the inserting chamber 15 of the electrical connector 100. At this time, the contact portions 23 of the electrical terminals 20 are still in the terminal grooves 16, namely there is no electrical connection between the electrical terminals 20 and the mating connector. Moreover, in this state, the locking sections 321 of the elastic strips 32 of the shell 30 are still in the through grooves 18 and don't stretch into the inserting chamber 15. In this state, the blocking blocks 193 of the insulating housing 10 are assembled against the rear sidewalls of the sliding slots 46 so as to avoid the pressing member 40 falling off the front part of the insulating housing 10.

Figure 5:
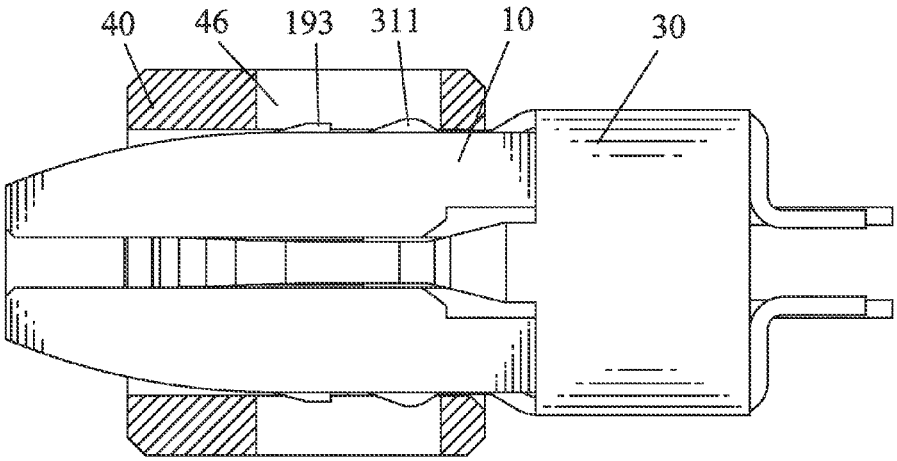
Figure 7:
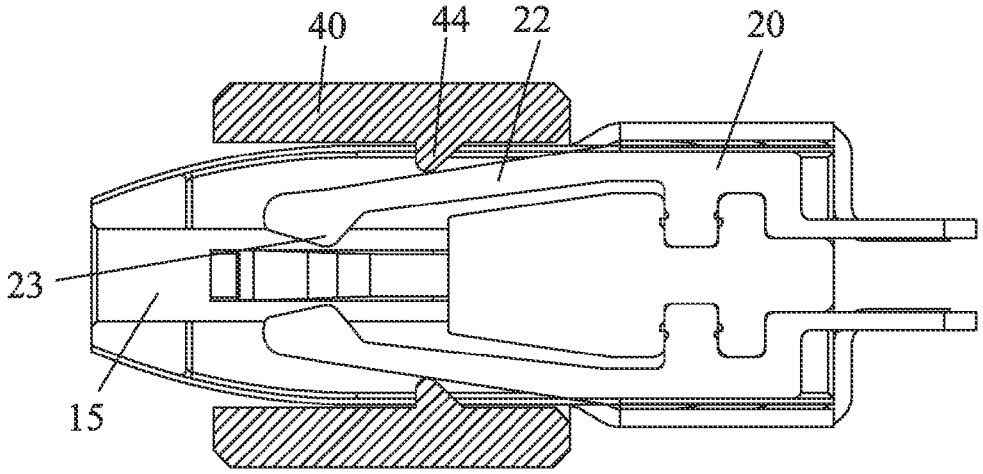

Referring to FIG. 5 and FIG. 7, after the mating connector is completely inserted in the electrical connector 100, push the pressing member 40 to slide rearward until the pressing member 40 slides over the locking portions 311 of the locking arms 31 of the shell 30 to make the locking portions 311 be buckled in the sliding slots 46 and against the rear sidewalls of the sliding slots 46 respectively. At this moment, the contact portions 23 of the electrical terminals 20 are pressed by the pressing blocks 44 to electrically contact with the mating connector, and the locking sections 321 of the elastic strips 32 of the shell 30 are pressed into the inserting chamber 15 by the slide blocks 45 to latch the mating connector and the electrical connector 100 together firmly. In detail, in the process of the pressing member 40 sliding rearward, the pressing blocks 44 slide along the corresponding elastic arms 22 of the electrical terminals 20 and press the elastic arms 22 to make the contact portions 23 project into the inserting chamber 15 so as to realize electrical connection with the mating connector, and simultaneously, the slide blocks 45 slide rearward in the sliding channels 17 and further press the elastic strips 32 to make the locking sections 321 project into the inserting chamber 15 so as to latch the mating connector and the electrical connector 100 together firmly for further ensuring a steady electrical connection between the mating connector and the electrical terminals 20. In this state, the locking portions 311 of the shell 30 are buckled in the sliding slots 46 and against the rear sidewalls of the sliding slots 46 so as to prevent the pressing member 40 from sliding forward.

As described above, the terminal grooves 16 in the top wall 11 and the terminal grooves 16 in the bottom wall 12 are symmetrical about the inserting chamber 15, and the electrical terminals 20 are symmetrically arranged in two rows and disposed in the terminal grooves 16 of the insulating housing 10, so the mating connector can be mated with the electrical connector 100 in positive and negative directions. Furthermore, there is no interference between the electrical terminals 20 and the mating connector in the process of inserting the mating connector into the electrical connector 100, and the electrical connection is realized between the electrical terminals 20 and the mating connector by virtue of pushing the pressing member 40 to slide rearward along the insulating housing 10 after the mating connector is completely mated with the electrical connector 100, so that effectively avoid scraping the mating connector in the process of insertion and extraction.

What is claimed is:

1. An electrical connector adapted for mating with a mating connector, comprising:

an insulating housing having a top wall, a bottom wall, a rear wall and two side walls which together surround an inserting chamber thereamong, the top wall and the bottom wall defining a plurality of terminal grooves vertically penetrating therethrough to communicate with the inserting chamber and each extending along a front-to-rear direction;

a plurality of electrical terminals disposed in the terminal grooves of the insulating housing, each of the electrical terminals having an elastic arm elastically received in the terminal groove, and a contact portion protruding towards the inserting chamber at a front end of the elastic arm, the contact portion being located in the front of the terminal groove; and a pressing member having a top board, a bottom board and two side boards, the pressing member being slidably sleeved round a front part of the insulating housing, two inner sides of the top board and the bottom board protruding face-to-face inward to form two rows of pressing blocks which are arranged at regular intervals in accordance with the terminal grooves of the insulating housing to project in the terminal grooves and resist against the elastic arms of the electrical terminals respectively;

wherein when the pressing member is at an initial position relative to the insulating housing, the contact portions of the electrical terminals are located in the terminal grooves and there is no interference between the electrical terminals and the mating connector in the process of inserting the mating connector into the electrical connector; after the mating connector is completely mated with the electrical connector, push the pressing member to slide rearward along the insulating housing so as to make the pressing blocks press the elastic arms to make the contact portions project into the inserting chamber and electrically contact with the mating connector.

2. The electrical connector as claimed in claim 1, further comprising a shell having a top plate, a bottom plate and two side plates which together enclose a rear part of the insulating housing, front edges of the top plate and the bottom plate curvedly extending forward to form a plurality of locking arms, a distal end of each locking arm being arched outward to form a locking portion projecting upward/downward beyond a top/bottom face of the side wall, the top board and the bottom board of the pressing member being opened with a plurality of sliding slots each extending along a front-to-rear direction and aligned with one of the locking portions of the shell, wherein the locking portions are located behind the pressing member when the pressing member is at the initial position, the pressing member is pushed rearward until it slides over the locking portions to make the locking portions be buckled in the sliding slots and against rear sidewalls of the sliding slots respectively.

3. The electrical connector as claimed in claim 2, wherein two top faces and two bottom faces of the side walls of the insulating housing define a plurality of wedge-shaped blocking blocks located at two opposite sides of the terminal grooves and each protruded apart in front of one of the locking portions of the locking arms of the shell, the blocking blocks are located in the corresponding sliding slots of the pressing member against the rear sidewalls of the sliding slots and apart from front sidewalls of the sliding slots when the pressing member is at the initial position.

4. The electrical connector as claimed in claim 3, wherein the top faces and the bottom faces of the side walls define a plurality of fillisters opened at substantial middles thereof and arranged behind the blocking blocks respectively, each of the locking arms of the shell has a substantial middle arched into the fillister to be buckled in the corresponding fillister.

5. The electrical connector as claimed in claim 4, wherein the top faces and the bottom faces of the side walls further define a plurality of buckling grooves arranged behind the fillisters respectively, the top plate and the bottom plate of the shell have two sides thereof punched inward to form two pairs of inclined buckling slices buckled in the buckling grooves of the insulating housing respectively.

6. The electrical connector as claimed in claim 4, wherein two rear ends of two opposite outsides of the side walls are concaved inward to form a pair of fastening grooves vertically extending to penetrate through the corresponding side walls, the side plates of the shell are positioned in the fastening grooves of the side walls.

7. The electrical connector as claimed in claim 2, wherein rear edges of the top plate and the bottom plate of the shell are bent towards each other and then extend rearward to form a plurality of soldering feet located behind the insulating housing and abutting against the back of the insulating housing.

8. The electrical connector as claimed in claim 2, wherein two opposite outsides of the side walls are concaved inward to form a pair of sliding channels extending along the front-to-rear direction to penetrate through the side walls, a pair of through grooves is face-to-face opened in substantial middles of insides of the side walls and transversely connect the corresponding sliding channels with the inserting chamber, front edges of the side plates of the shell extend forward and are curved towards each other more than once to form a pair of elastic strips disposed in the rears of the sliding channels, two distal ends of the elastic strips are further arched towards each other to form a pair of locking sections located in the through grooves when the pressing member is at the initial position, two inner sides of the side boards of the pressing member protrude face-to-face inward to form a pair of slide blocks inserted in the front of the sliding channels, the slide blocks slide rearward in the sliding channels along with the pressing member and press the elastic strips to make the locking sections project into the inserting chamber and latch the mating connector and the electrical connector together.

9. The electrical connector as claimed in claim 1, wherein the terminal grooves are opened symmetrically about the inserting chamber and the electrical terminals are symmetrically arranged in two rows.

10. The electrical connector as claimed in claim 1, wherein each of the electrical terminals further has a fastening portion fastened in the rear of the corresponding terminal groove, and a soldering tail extending rearward from a rear edge of the fastening portion to project behind the rear wall, the elastic arm extends forward from a front edge of the fastening portion and is inclined towards the inserting chamber in the process of extending forward.

* * * * *